US010278467B2

(12) United States Patent
Beqaj

(10) Patent No.: US 10,278,467 B2
(45) Date of Patent: May 7, 2019

(54) MULTI-PURPOSE HANDLE ENCASEMENT ACCESSORY

(71) Applicant: CVB Global LLC, New York, NY (US)

(72) Inventor: Claudia Beqaj, New York, NY (US)

(73) Assignee: CVB Global LLC, New York, NY (US)

( * ) Notice: Subject to any disclaimer, the term of this patent is extended or adjusted under 35 U.S.C. 154(b) by 0 days.

(21) Appl. No.: 15/114,595

(22) PCT Filed: Jun. 23, 2015

(86) PCT No.: PCT/US2015/037203

§ 371 (c)(1),
(2) Date: Jul. 27, 2016

(87) PCT Pub. No.: WO2015/200336

PCT Pub. Date: Dec. 30, 2015

(65) Prior Publication Data

US 2016/0345698 A1 Dec. 1, 2016

Related U.S. Application Data

(60) Provisional application No. 62/016,403, filed on Jun. 24, 2014.

(51) Int. Cl.
*A45C 13/00* (2006.01)
*A45C 13/26* (2006.01)
(Continued)

(52) U.S. Cl.
CPC ..... *A45C 13/002* (2013.01); *A45C 13/08* (2013.01); *A45C 13/26* (2013.01); *A45C 13/28* (2013.01); *A45F 2005/1013* (2013.01)

(58) Field of Classification Search
CPC ..... A45C 13/002; A45C 13/08; A45C 13/26; A45C 13/28
See application file for complete search history.

(56) References Cited

U.S. PATENT DOCUMENTS 1,708,144 A * 4/1929 Martin ..... A41D 17/00 2/61
2,274,605 A * 2/1942 Hoffmeister ..... A45C 13/26 16/411

(Continued)

FOREIGN PATENT DOCUMENTS

FR 1235049 7/1960

OTHER PUBLICATIONS

Shearer. Hermes Kelly Bag with Twilly wrap | How to add Twily to Hermes Kelly. YouTube. Oct. 2, 2011. [retrieved on Aug. 24, 2015]. Retrieved from internet <URL:https://www.youtube.com/watch?v=mUTYRcTMUo> entire video.

(Continued)

*Primary Examiner* — Tri M Mai
(74) *Attorney, Agent, or Firm* — Hughes Hubbard & Reed LLP; James R. Klaiber

(57) ABSTRACT

The present invention provides a device and method for protecting the handle of a handbag comprising an approximately rectangular piece of fabric having a top face and a bottom, face and a left side and a right side and a closure for joining the left side to the right side. It also provides a device and method for protecting the handle of a handbag comprising an approximately rectangular piece of fabric having a top face and a bottom face wherein said fabric is adapted to be coiled around the handle of the handbag and ends adapted to be tied around the handle of the handbag.

7 Claims, 4 Drawing Sheets

(51) Int. Cl.

| | |
|---|---|
| ***A45C 13/28*** | (2006.01) |
| ***A45C 13/08*** | (2006.01) |
| *A45F 5/10* | (2006.01) |

(56) References Cited

U.S. PATENT DOCUMENTS

| | | | | | |
|---|---|---|---|---|---|
| 2,431,287 | A | * | 11/1947 | Washington | A41D 13/065 2/239 |
| 3,397,913 | A | * | 8/1968 | Fein | B60R 22/00 297/482 |
| 4,262,385 | A | * | 4/1981 | Norman | A45C 13/26 112/441 |
| 5,118,107 | A | | 6/1992 | Bucher | |
| 5,357,049 | A | * | 10/1994 | Plummer, III | H01B 11/1008 174/36 |
| D357,791 | S | * | 5/1995 | Granda | D2/639 |
| 5,427,392 | A | * | 6/1995 | Duer | B62B 5/06 150/154 |
| 8,118,762 | B2 | * | 2/2012 | Bort | A61F 13/062 602/23 |
| 8,695,168 | B1 | | 4/2014 | Cepeda | |
| 9,301,553 | B1 | * | 4/2016 | Donovan | A41D 1/00 |
| D762,588 | S | * | 8/2016 | Chin | D13/155 |
| 2007/0193902 | A1 | | 8/2007 | Myers et al. | |
| 2010/0236287 | A1 | | 9/2010 | Summerford | |

OTHER PUBLICATIONS

PCT International Search Report for Int'l App. No. PCT/US2015/037203; dated Sep. 15, 2015; 4 pages.

PCT Written Opinion of the International Searching Authority for Int'l App. No. PCT/US2015/037203; dated Sep. 15, 2015; 19 pages.

PCT Article 19 Amendment for Int'l App. No. PCT/U52015/037203; dated Nov. 13, 2015; 8 pages.

Supplementary European Search Report, European Application No. EP 15 81 1894, dated Jan. 4, 2018.

First Office Action, Chinese Patent Application No. 201580034709.6 (Chinese language).

First Office Action, Chinese Patent Application No. 201580034709.6 (English translation).

* cited by examiner

MULTI-PURPOSE HANDLE ENCASEMENT ACCESSORY

RELATED APPLICATIONS

This application claims priority to U.S. Provisional Patent Application No. 62/016,403, filed Jun. 24, 2014, the disclosures and teachings of which are incorporated herein by reference.

FIELD OF THE INVENTION

The accessory is a fashion accoutrement that is intended to serve as a protective cover for bag handles from normal wear and tear of daily use, as a restorative covering, as a decoration or adornment, to improve comfort, and to improve upon an existing bag style.

BACKGROUND OF THE INVENTION

The global handbag and purse manufacturing markets are expected to generate $96 billion dollars by year end 2013, as disclosed online at the website of IBISWorld which can be found at http://www.ibisworld.com/industry/global/global-handbag-purse-manufacturing.html. This market encompasses exceedingly dynamic players and an expanding consumer base, which is expected to flourish due to increasing demand from emerging markets and strong performances by the international luxury brands. The top 10 markets for luxury handbags collectively gathered over 120 million online searches, demonstrating substantial global demand for the world's most coveted luxury items. The WorldHandbagReport™ reveals the United States as the dominating force in the luxury handbag market, capturing a monumental number of searches, to claim the largest market share at almost 48%. Even more astounding is the United States retaining its title as the largest market even when compared to the European markets collectively as well as the BRIC markets en masse. A recovering economy and surge in online sales has fueled the demand from American handbag consumers to thrust the market into the number one position as disclosed in the WorldHandbagReport™ © Digital Luxury Group. Report Extract. November 2012.

Looking at the enormity of the handbag market, it is typical for woman and men to have a variety of bags with multiple styles, sizes, and purpose for their use. Handbags and other bags carried by hand are very common fashion accessories, and as demonstrated by numerous research reports, the industry is continuing to grow.

Handbags can be made of various materials including, but not limited to; leather, man-made fabrics, silks, polymers/plastics, metal, denim, fur and newer vegetable based fabrics. Most of the materials used in handbags are porous in nature, and are subject to the wear-and-tear of daily use. Often, bags that are carried by bare hands holding the handles may attract dirt and grime from the carrier's hands or from elements in the air that can discolor or contaminate the surface. This can lead to undesirable discoloration on the handles of the bag and in some instances, can make the bag unusable or unsightly. Since most of the handbags being sold have handles which are anchored to the bag with some type of miscellaneous hardware, it is not possible to remove the handle to replace it with a newer one. Sometimes, the only option for these bags is to be cleaned by professional cleaners that are specialized in cleaning such materials. The cost of such cleaning can be very high, and sometimes, can result in further damage being done to the bag.

Another challenge that is sometimes presented in the handbag market is that a person may have a need for such a handbag, but would like to slightly change the look of the bag, either to enhance the appearance, or to make it more customized or appropriate for a specific occasion. There are very few options at this time for people who may enjoy having all of their accessories coordinate, and sometimes, they may feel the need to purchase additional handbags in order to get the look and appearance that they would like.

Overall, the handbag market has been growing for many years, and as it does, the need for new accessories to protect, revamp and restore these products is very evident.

The present invention described herein provides a device for covering and protecting the handles of a handbag that can be easily attached, removed, or adjusted. The invention further provides an accessory for the bag which can alter its look for additional embellishment.

DESCRIPTION OF THE PRIOR ART

To the Applicant's knowledge, no prior art exists that provides a system or method for an easily attachable and removable handbag handle cover that provides additional embellishment to the handbag.

SUMMARY OF THE INVENTION

The present invention provides a device and method for protecting the handle of a handbag comprising an approximately rectangular piece of fabric having a top face and a bottom face and a left side and a right side and a closure for joining the left side to the right side. It also provides a device and method for protecting the handle of a handbag comprising an approximately rectangular piece of fabric having a top face and a bottom face wherein said fabric is adapted to be coiled around the handle of the handbag and ends adapted to be tied around the handle of the handbag.

DETAILED DESCRIPTION OF THE INVENTION AND DRAWINGS

Description will now be given with reference to the attached FIGS. 1-6. It should be understood that these figures are exemplary in nature and in no way serve to limit the scope of the invention, which is defined by the claims appearing herein below.

Figure 1:
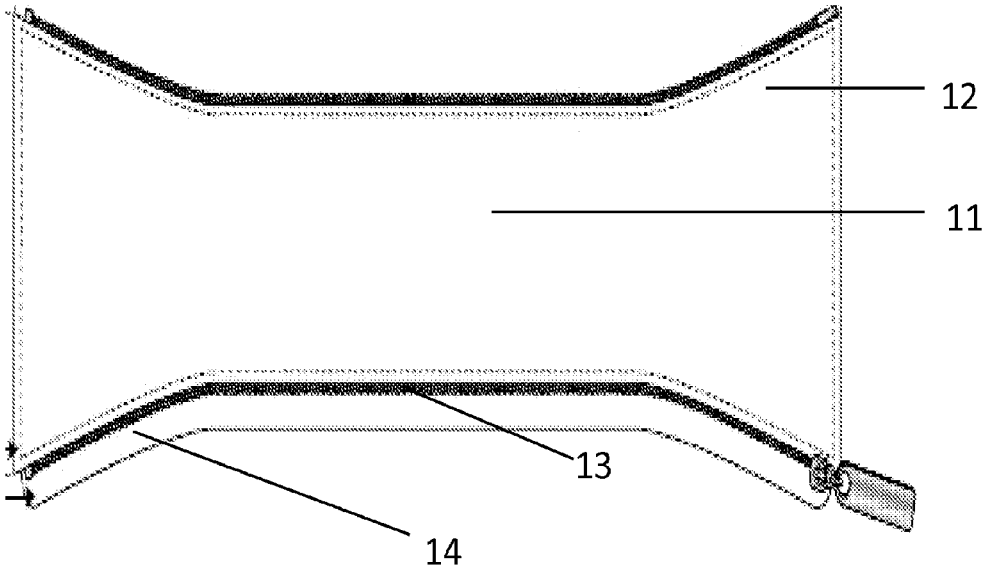
FIG. 1 is the top perspective view of the zipper technique multi-purpose handle encasement unit in accordance with the invention.
Figure 2:
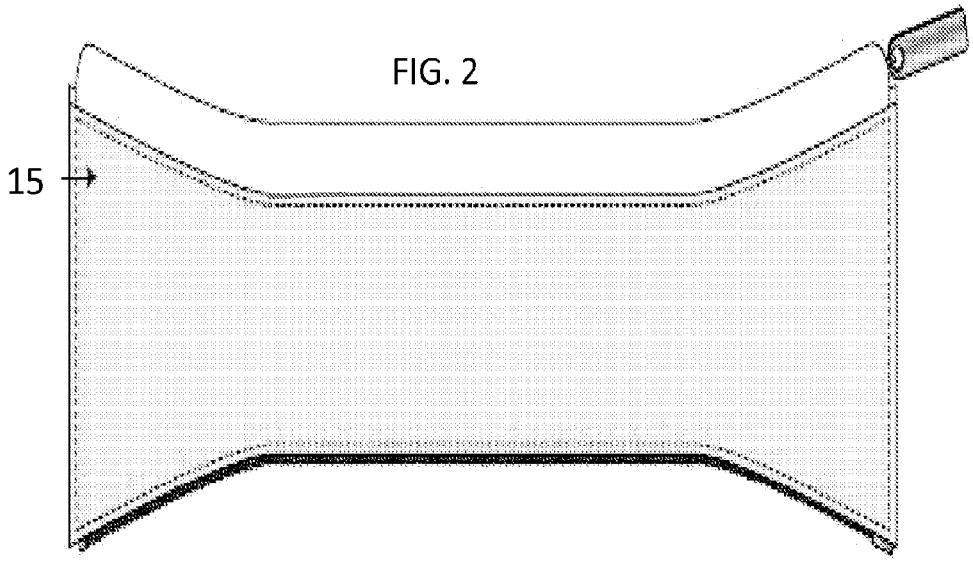
FIG. 2 is the bottom perspective view of the multi-purpose handle encasement unit of FIG. 1.
Figure 3:
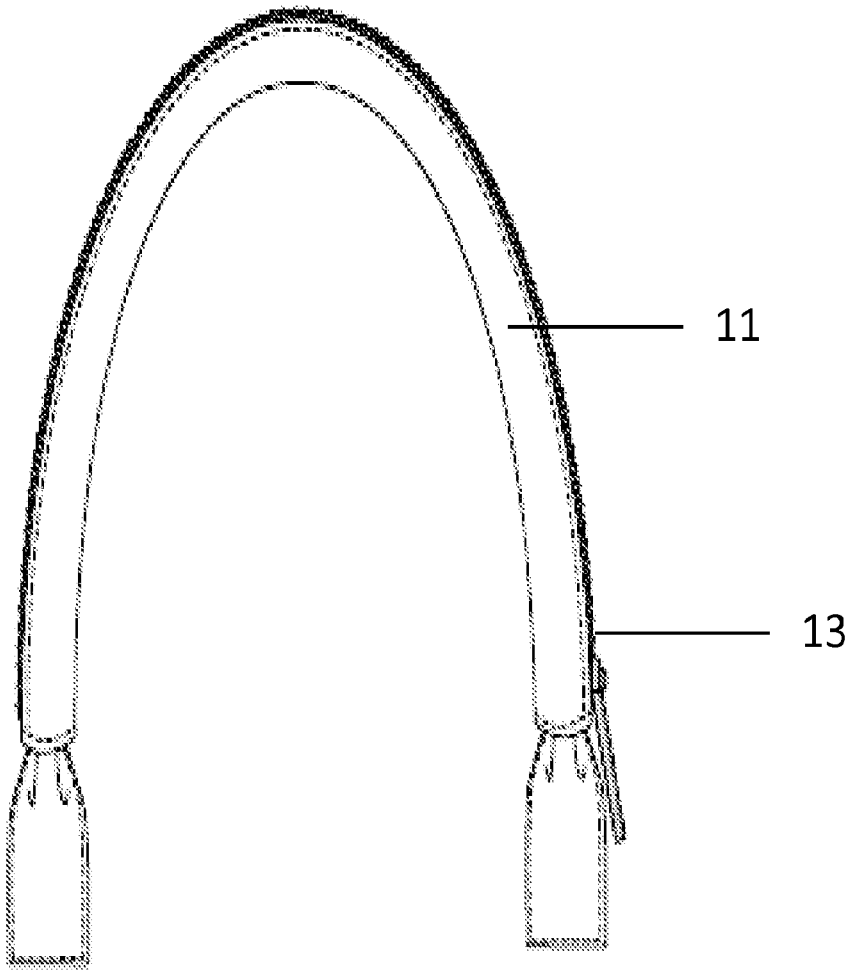
FIG. 3 is the perspective view of the zipper technique multi-purpose handle encasement unit in position on a handbag handle.

As shown in FIGS. 1 and 2, the multi-purpose handle encasement unit is comprised of a layer of material (11) intended to be wrapped around the handles of a bag, which is fluted (12) or flared on both ends, in order to fit appropriately around the handles. The material is fitted with a custom sized, separating one way zipper (13) that runs the entire length of the material. There is an extra segment of material (14) near the zipper that prevents the zipper from touching and scraping against the handle when the invention is in place on the handle. FIG. 1 shows a top perspective of this embodiment of the invention and FIG. 2 shows a bottom perspective of the embodiment of the invention. When the invention is in place, it will form an encasement around the handle, as seen in FIG. 3. The invention includes a material lining (15) which will make up the interior surface of the invention when the invention is in place on the handle. Only this lining will come in contact with the handle to prevent the outside material from touching the handles. The lining is thus preferably made of a softer, less abrasive fabric than the exterior fabric.

FIG. 3 shows the invention fully assembled, and wrapped around an illustrative handbag handle. The top layer of the material (11) is the only piece of fabric shown as lining (15) is in the interior. The zipper (13) is shown from an interlocked position which connects the two sides of the material to form a cylindrical encasement around the handle. It should be noted however that the attachment mechanism can take other forms than a zipper however. For example, the material might be held in place by snaps, magnets, grommets, hook and eye hardware, Velcro, plastic molding, tubing, poured plastic, or injection molded plastic and any miscellaneous hardware that may be used to adjoin two pieces of material. The zipper or other attachment mechanism may be for either functional or decorative purposes.

This embodiment of the invention is easily wrapped around a handbag handle by first placing the opened, unzipped invention either on top of the handle, or in the space between the handle and the handbag, in such a way that the lining is touching or facing the handle and the zipper or other closure mechanism is in alignment with the handle. The zipper or other closure mechanism is then closed, pulling the two side edges of the invention together to create a cylindrical enclosure around the handle. The handle will then be enclosed and protected. The invention may later be easily removed by unzipping the zipper and simply removing the handle from its position.

Figure 4:
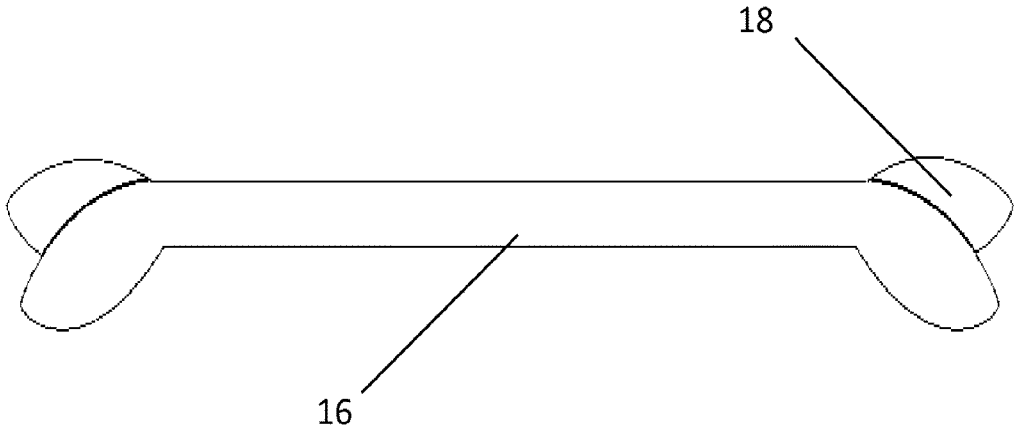
FIG. 4 is a top perspective view of the wrapping technique multi-purpose handle encasement unit.
Figure 5:
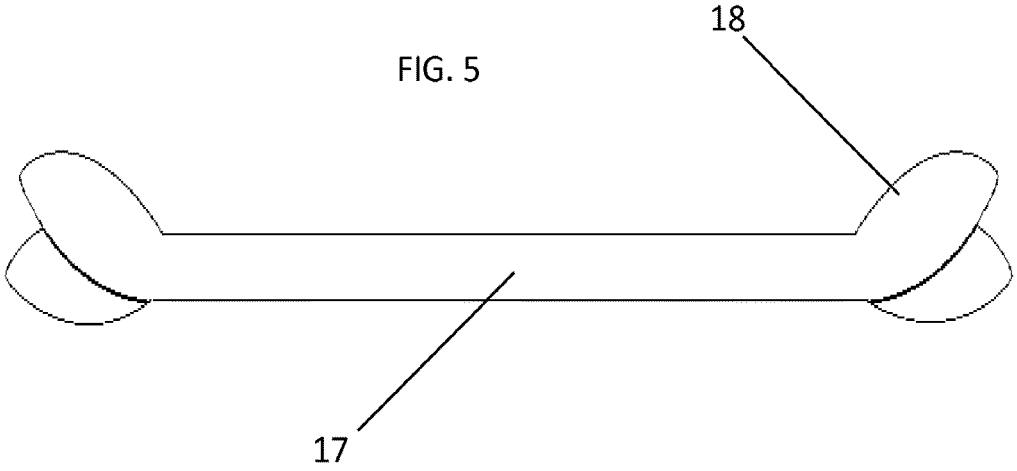
FIG. 5 is the bottom perspective view of the wrapping technique multi-purpose handle encasement unit of FIG. 4.
Figure 6:
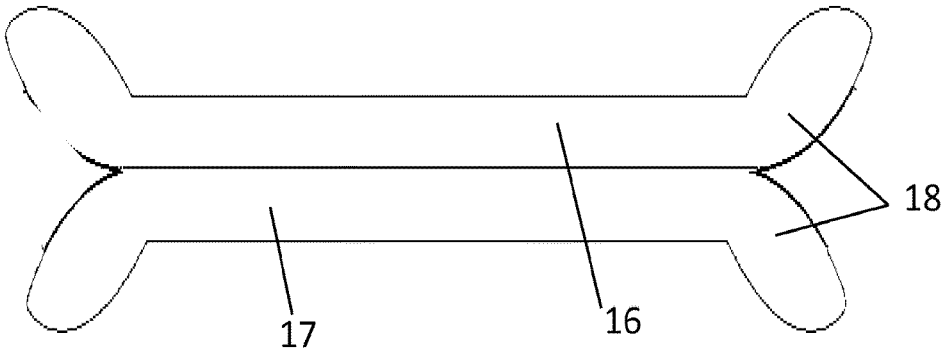
FIG. 6 is a top perspective view of the wrapping technique multi-purpose handle encasement unit of FIG. 4 unsewn.
Figure 7:
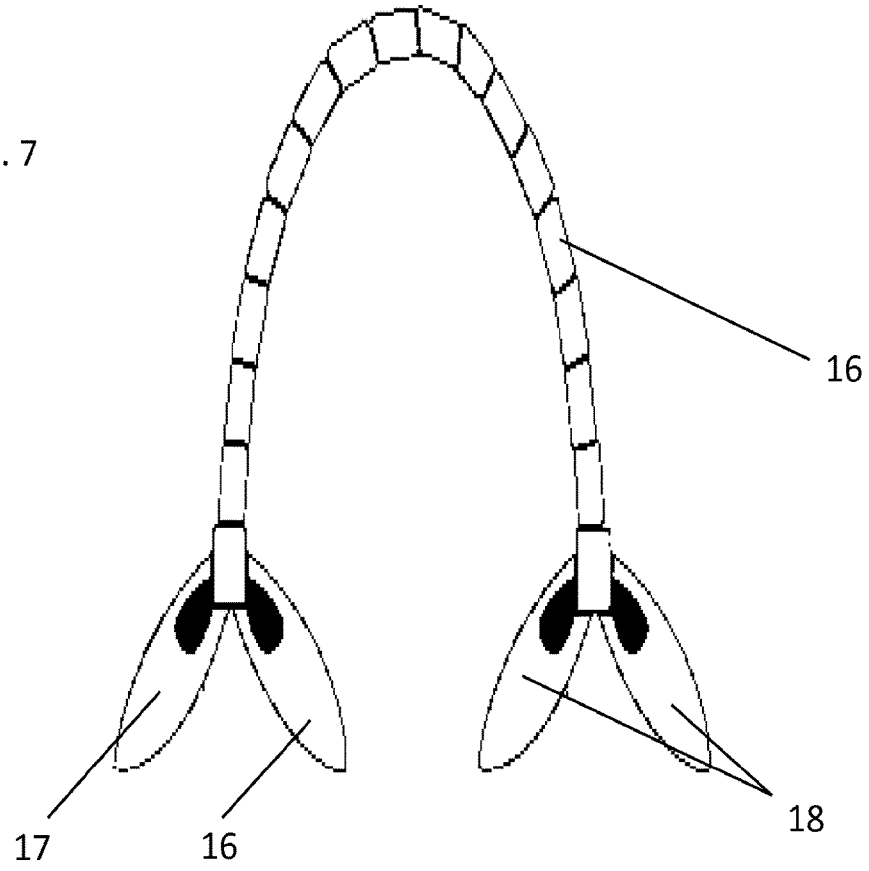
FIG. 7 is the perspective view of the wrapping technique multi-purpose handle encasement unit shown utilizing the wrapping technique and fully encapsulating the handle.

An alternative design for the multi-purpose handbag handle encasement accessory outlined above, is depicted in FIGS. 4-7. FIG. 4 shows the top view of the invention showing the fabric (16) used for one half of the accessory. FIG. 5 is a bottom view of the invention showing a second piece of fabric (17) that comprises the bottom portion of the accessory. These halves are unique in the way that they are adjoined to one another. As seen in FIGS. 5 and 6, the entire lengths of the two fabrics are stitched together, and the ends (18), which appear free-flowing and loose, are stitched in such a way, that they create a 'fork' in the fabric at the very ends. That is the end of piece 16 is not sewn to the end of piece 17. This can be seen in FIG. 7 (18). FIG. 7 depicts the accessory wrapped around an illustrative handbag handle, showing the top layer of fabric (16) stitched to the bottom layer of fabric (17) with the forked ends (18) having the ability to be tied in a knot or bow in order to secure the accessory to a handbag. This is accomplished by coiling the invention around the handle rather than simply zipping a zipper as done in the first described embodiment. The coil is kept in place by tying a knot at the end of the invention using the "forks." Thus, this embodiment is fully functional without the use of any hardware. This accessory utilizes the intended design of being wrapped around a handle, with the fabric stitched in such a way that it has two forked ends that enable it to be tied around the existing hardware on a bag.

The invention is not limited to the above description. For example, the pieces can be made of various different fabrics, and can utilize other closure methods other than a zipper. In the place of the zipper, there can be snaps, Velcro, magnets, miscellaneous hardware, etc. These variations are considered to be within the scope of the invention.

Either embodiment of the invention may exist solely for the purpose of being decorative too and therefore may utilize such ornamentation as jewelry, rhinestones and other adornments or embellishments.

It will be understood by those of ordinary skill in the art that various changes may be made and equivalents may be substituted for elements without departing from the scope of the invention. In addition, many modifications may be made to adapt a particular feature or material to the teachings of the invention without departing from the scope thereof. Therefore, it is intended that the invention not be limited to the particular embodiments disclosed, but that the invention will include all embodiments falling within the scope of the claims.

What is claimed is:

1. A device for protecting the handle of a handbag comprising:

an approximately rectangular piece of fabric with a rectangular midsection having a uniform width and trapezoidal flared ends having a top face and a bottom face and a left side and a right side, said left and right sides opposing each other, and having a top edge at a first flared end, and a bottom edge at a second flared end, said top and bottom edges opposing each other, wherein said top and bottom edges have a common width wider than said midsection width, and said midsection located between said first and second flared ends;

a zipper for joining the left side to the right side; said zipper extending along the entire length of said left side and said right side, including the entire length of said flared ends.

2. A device as claimed in claim 1 wherein said top face and said bottom face are of different types of fabric and wherein said top face is made of a softer fabric than the fabric of the bottom face.

3. A device as claimed in claim 1 further comprising a second piece of fabric near the zipper wherein said second piece of fabric lies between the zipper and the handle when the device is closed around the handle of the handbag.

4. A device as claimed in claim 1 wherein said top face and said bottom face provide an extra layer of cushioning to existing handbag handles.

5. A device as claimed in claim 1 wherein:

said left side having a first portion extending along said first flared end from said bottom edge to said midsection at a first angle to said bottom edge and at a second angle to said midsection, a second portion extending along said midsection, and a third portion extending from said midsection along said second flared end to said top edge at said first angle to said top edge and at said second angle to said midsection, said right side having a first portion extending along said first flared end from said bottom edge to said midsection at said first angle to said bottom edge and at said second angle to said midsection, a second portion extending along said midsection, and a third portion extending from said midsection along said second flared end to said top edge at said first angle to said top edge and at said second angle to said midsection.

6. A device as claimed in claim 5 wherein:

said zipper extends substantially continuously along substantially all of said first, second, and third portions of said left side and said first, second, and third portions of said right side.

7. A device as claimed in claim 5 wherein:

said second portion of said left side is approximately parallel to said second portion of said right side.

* * * * *